United States Patent [19]

Horwitt

[11] 4,184,350

[45] Jan. 22, 1980

[54] HIGH-PRODUCTION METHOD AND APPARATUS FOR MAKING SPIRAL CONVOLUTION ELECTRICAL HEATING COILS

[75] Inventor: Laurence G. Horwitt, New Haven, Conn.

[73] Assignee: Sun Chemical Corporation, New York, N.Y.

[21] Appl. No.: 919,397

[22] Filed: Jun. 26, 1978

[51] Int. Cl.[2] ..... B21C 47/06

[52] U.S. Cl. ..... 72/132; 72/148

[58] Field of Search ..... 72/129, 130, 132, 142, 72/146, 147, 148, 371

[56] References Cited

U.S. PATENT DOCUMENTS

| | | | |
|---|---|---|---|
| 249,871 | 11/1881 | Baker | 72/148 |
| 323,100 | 7/1885 | Baker | 72/148 |
| 2,475,856 | 7/1949 | Price | 72/148 |
| 2,579,858 | 12/1951 | Price | 72/148 |
| 2,721,952 | 10/1955 | Kenyon | 72/148 X |
| 3,283,399 | 11/1966 | Hart et al. | 72/142 |
| 3,346,938 | 10/1967 | Becker | 72/146 X |
| 3,905,090 | 9/1975 | Painter | 29/455 |

FOREIGN PATENT DOCUMENTS

| | | | |
|---|---|---|---|
| 590410 | 1/1934 | Fed. Rep. of Germany | 72/148 |
| 986854 | 3/1965 | United Kingdom | 72/148 |
| 447205 | 12/1975 | U.S.S.R. | 72/146 |

OTHER PUBLICATIONS

"Winding of Metal Evaporator Charge Coils," Anderson et al., Western Electric Technical Digest No. 45, Jan. 1977, pp. 1 & 2.

*Primary Examiner*—Ervin M. Combs
*Attorney, Agent, or Firm*—Cynthia Berlow

[57] ABSTRACT

A high production method and apparatus which utilizes ribbon-like resistance wire to produce spiral wound electrical heating coils as used in cigar lighters, ignitor plugs and the like. Nesting of adjoining convolutions, if desired, can be effected by first imparting a transverse, ribbed configuration to the ribbon prior to the winding of the same into the spiral coil. In accomplishing this transverse configuring, cooperable male and female rolls, turning in opposite directions, form the ribbon and simultaneously cut it into lengths at a high production rate. After an annealing process, the cut strips of ribbon are fed to a coiling machine which has a notched arbor that receives end portions of the strips and coils the latter into a spiral shape while restraint is imposed on the strips. The feeding, confining, winding and ejection procedures involving the strips are automatically, sequentially carried out at a high production rate.

32 Claims, 28 Drawing Figures

Fig. 13
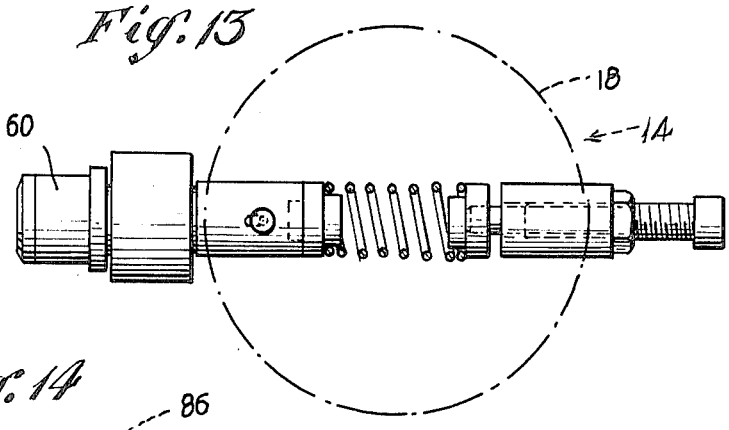
Fig. 14
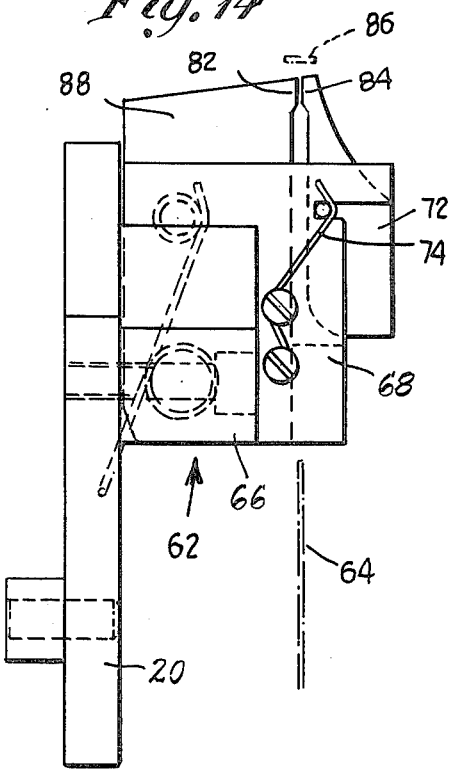
Fig. 15
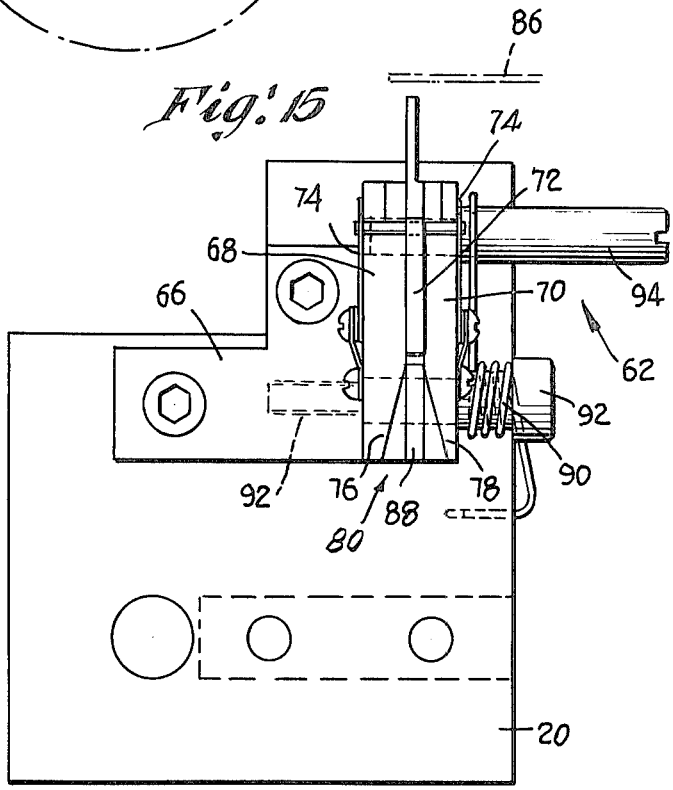
Fig. 16
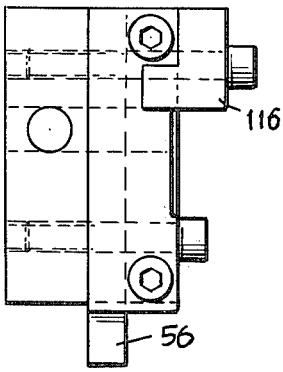
Fig. 18
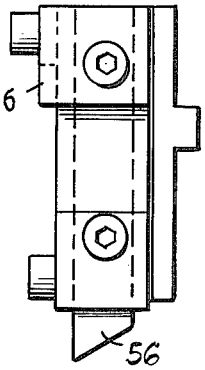
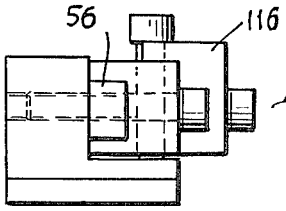
Fig. 17

HIGH-PRODUCTION METHOD AND APPARATUS FOR MAKING SPIRAL CONVOLUTION ELECTRICAL HEATING COILS

CROSS REFERENCES TO RELATED APPLICATIONS

Copending application of Laurence G. Horwitt entitled High-Production Method and Apparatus For Making Grooved Resistance Ribbon for Electrical Heating Coils, Ser. No. 908,098, filed May 22, 1978.

BACKGROUND

This invention relates to electric heating coils as used in cigar lighters, ignitor plugs and the like, and more particularly to a production method and apparatus by which spiral heating coils (which can if desired have nestable convolutions) are produced.

For many years the heating coils of electric cigar lighters as used in automobiles were wound of flat, ribbon-like resistance wire into a spiral coil shape, utilizing an arbor and related fixtures, in a relatively slow speed process involving appreciable hand labor and handling. As so produced, the heating elements were somewhat costly and in many cases lacked uniformity, being not of especially high quality, since rigid standards were not usually required. Such heating elements were utilized with 6-volt electrical systems of automobiles, for the most part. When automobile electrical systems were improved by changing to 12-volt batteries it became necessary to use a greater length of thinner resistance-wire ribbon in the cigar lighters so as to accommodate these to the higher voltage. In so doing, the spiral-wound heating elements were found to be much less sturdy and rugged, and many instances occured where the coil convolutions become deformed or short-circuited, causing a safety hazard in addition to rendering the cigar lighter inoperative.

In order to remedy this condition, spiral-wound heating coils were experimented with and produced where a ribbed or angular cross-sectional configuration was imparted to the ribbon, so as to cause nesting of adjoining convolutions of the spiral coil whereby greater rigidity and mutual support were had. This resulted in an improved, sturdier and more rugged coil, and eliminated to a great extent the prior coil failures and burnouts. The ribbing of the ribbon was done by placing cut lengths in a flat die of a press, and applying a punch to the ribbon to form the groove-like configuration. This particular procedure was not only lengthy and costly, but it also produced a high percentage of rejects. Thus, while a solution to one problem was had, there arose other problems which tended to detract from the advantages of ribbing the ribbon. For example, the use of thinner ribbon resulted in coils being more unwieldly, and greater care was required in performing the spiral winding. Due to the hand operations which were involved, regardless of whether or not the ribbon was ribbed, the labor cost remained high. In addition, there was lacking the uniformity and high quality which generally characterizes parts or components that are accurately made mostly by machine operations capable of being closely controlled.

SUMMARY

The above drawbacks and disadvantages which are attendant the forming of cigar lighter and ignitor plug heating coils, and particularly those coils wherein adjoining convolutions nest with each other, are obviated by the present invention which has for one object the provision of an improved method and apparatus for producing spiral-wound, close-convolution heating elements, by which a high rate of manufacturing production is achieved.

Another object of the invention is to provide an improved method and apparatus for producing electric heating coils as above set forth, wherein only a very small percentage of rejects occurs, thereby resulting in a desirable economy of manufacture.

yet another object of the invention is to provide an improved method and apparatus for producing electric heating coils in accordance with the foregoing, which is relatively simple and foolproof, thereby minimizing the amount of capital expenditure which is required.

A feature of the invention resides in the modifying of an existing type of automatic screw machine to effect the carrying out of the improved process for spiral coiling.

A further feature of the invention resides in the provision of an improved apparatus as above characterized, which operates economically and requires a minimum amount of maintenance.

Another feature of the invention resides in the provision of an improved high-production coil-making apparatus which is relatively small and compact, requiring but little space and also a minimum of power.

Still other features and advantages will hereinafter appear.

In accomplishing the above objects the invention provides an apparatus and method wherein flat ribbon-like resistance wire stock is fed from a supply spool, between a pair of cooperable male and female rolls which, if desired, can have peripheral configurations that are adapted to impart a particular ribbed or grooved cross-sectional configuration to the ribbon, such rolls automatically cutting the ribbon into predetermined lengths. Thereafter, the formed and cut lengths of ribbon, if they have workhardened, are annealed in a furnace at high temperature.

After annealing, the cut lengths of ribbon, which can but need not be of formed transverse configuration, are fed, one at a time, end first into an opening in an arbor. After each insertion of a length of ribbon, the arbor is turned by power through a predetermined number of revolutions while restraint is placed on the ribbon, thereby to form the spiral coils. During the winding of the spiral, the opposite longitudinal edges of the ribbon are confined.

In the embodiment of the invention illustrated herein there is an intermediate step of bringing the end portions of the formed and cut ribbon, one at a time, into engagement with a stop, after which the ribbon is automatically advanced end-wise so as to insert its foremost end portion into the opening of the arbor.

Prior to the automatic advancement of the ribbon into the arbor, the stop which positioned the ribbon is shifted out of engagement therewith, while the ribbon is meanwhile being frictionally gripped in the apparatus, in preparation for its forward movement. The restraint that is placed on the ribbon during the winding thereof is accomplished by an advanceable and retractable pressure roll. Upon completion of the winding of the spiral, one of the confining means for the edge portions of the ribbon is withdrawn and the arbor is automatically withdrawn axially in an opposite direction, whereby the spirally-coiled ribbon is free for removal. Such confining of the opposite longitudinal edges of the ribbon is effected as the spiral coiling thereof proceeds. The confining means cooperate with each other to provide a deep, annular groove which can be occupied by the pressure roll.

The gripping of the ribbon during its advance is done by a friction device which enables the ribbon to be pulled through it easily as the turning of the arbor proceeds.

The method and apparatus by which spiral, nested or not-nested convolution heating coils are made, are thus simple and characterized by automatic or powered operations which result in a high rate of production.

In the accompanying drawings:

FIG. 13 is a front elevational view of the rotary abutment assemblage of the apparatus, which is carried by the turret assembly.

FIG. 14 is a side elevational view of the ribbon receiving and holding device of the apparatus.

FIG. 15 is a top plan view of the holding device of FIG. 14.

FIG. 16 is a top plan view of the collect stop device of the apparatus, which is carried by the back slide.

FIG. 17 is a front elevational view of the collet stop device of FIG. 16.

FIG. 18 is a side elevational view of the collet stop device.

Figure 1:
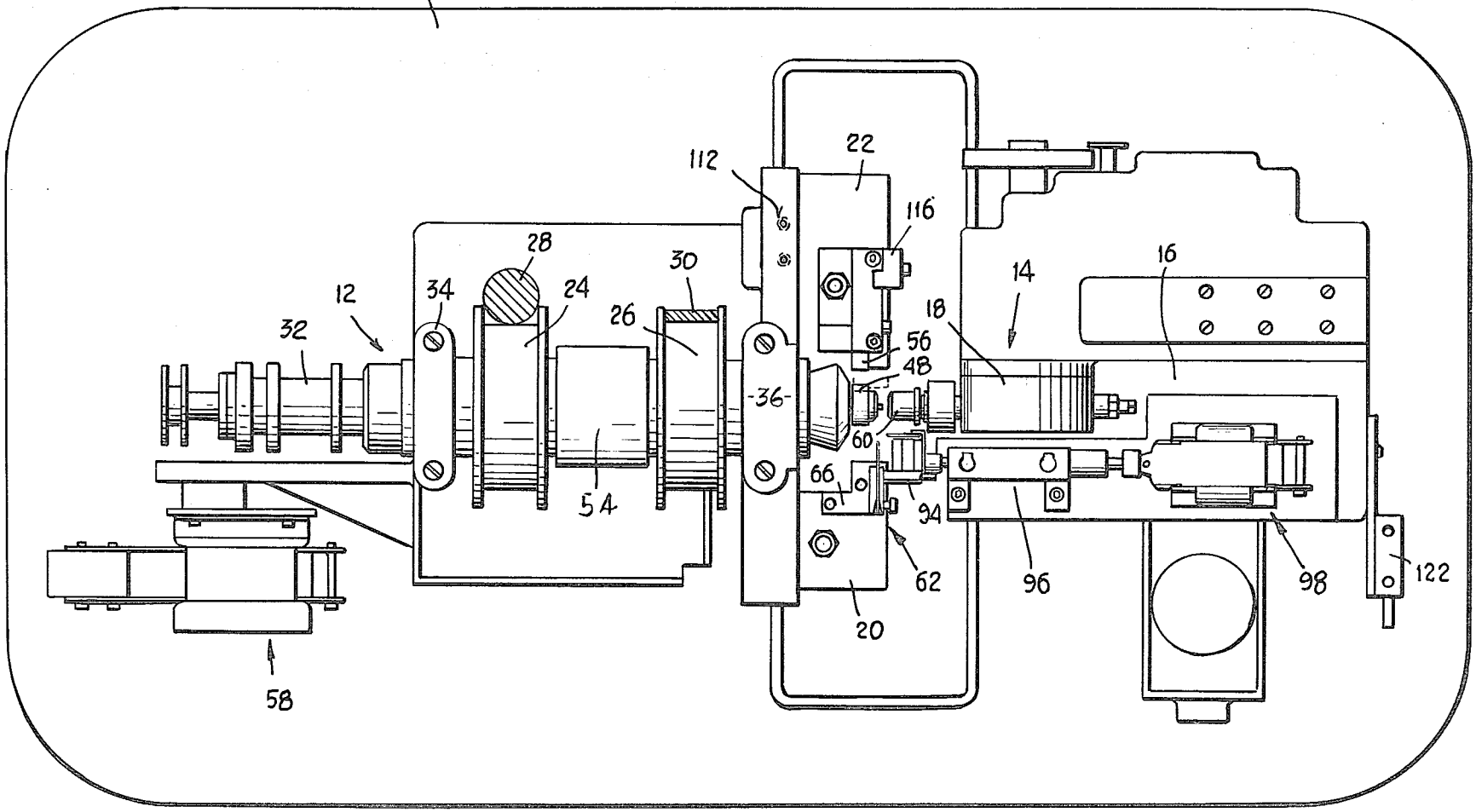
FIG. 1 is a top plan view of a wire-ribbon coiling apparatus as provided by the invention, shown on a reduced scale.

Referring first to FIG. 1, the machine of the present invention is shown as comprising a base 10 on which there is turnably mounted a horizontal spindle assemblage designated generally by the numeral 12, said assemblage being cooperable with a turret assembly 14 that is carried by a slide 16 movable horizontally from left to right and vice-versa on the base 10. The turret assembly 14 includes a turret head 18 which is turnable about a horizontal axis. The machine further comprises front and rear horizontal slides 20, 22 mounted for advancing and retracting movement on the base 10. The machine in FIG. 1 is constructed from a typical Brown & Sharpe #00 Screw Machine, which is modified to suit the purpose of the invention.

The spindle assemblage 12 includes pulleys 24 and 26 around which respectively pass round and flat driving belts 28, 30. The spindle assemblage 12 further comprises a shaft or spindle 32 that is carried in bearings 34, 36 and has a collet assembly 38 (FIG. 2) carrying an arbor 40. The arbor is mounted in a holder 42 which has splines 44 engageable in the slots 46 of the collet assembly 38. The collet assembly 38 includes a collet 48 in which the slots 46 are disposed, said collet having a spiral abutment portion 50 providing a stop shoulder 52 the purpose of which will be explained below.

The mchine has a clutch device 54 which is adapted to effect a drive between the pulley 26 on the one hand and the shaft 32 and collet assembly 38 on the other hand. Details of the clutch device 54 are not given herein, since it is supplied as part of the standard Brown & Sharp #00 Screw Machine. The usual operation of this screw machine, involving the clutch device 54, enables the collet assembly 38 to be either driven by the belt 30 and pulley 26 when the clutch is engaged, or else by the belt 28 and pulley 24 when the clutch is disengaged.

The belt 28 is kept under loose tension at all times and can readily slip on the pulley 24, whereas the belt 30 is normally tightly tensioned and effects a positive drive to the pulley 26. If the clutch device 54 is engaged, this positive drive is transmitted to the collet assembly 38.

With the clutch 54 disengaged, a stop 56 on the back slide 22 can halt the collet assembly 38 by its engagement with the shoulder 52 of the collet 48 at such times that the back slide 22 is advanced or shifted forward. With the collet assembly 38 stopped from turning, slippage of the belt 28 on the pulley 24 will occur, and the continual slip-drive which is effected by the belt 28 insures that the collet 38 and the arbor 40 carried thereby can always be halted in one given rotative position. The round slip-drive belt 28 is driven at low speed, whereas the flat belt 30 is driven at a relatively high speed; accordingly, high speed turning of the arbor 40 can be effected, and a halting of the collet assembly 38 and arbor 40 can be easily accomplished when these are turning at low rotative speeds under the slip-drive of the belt 28.

The starting lever (not shown) of the converted Brown & Screw #00 screw machine is actuated by a solenoid assemblage 58, in the usual manner characteristic of such screw machines.

Figure 2:
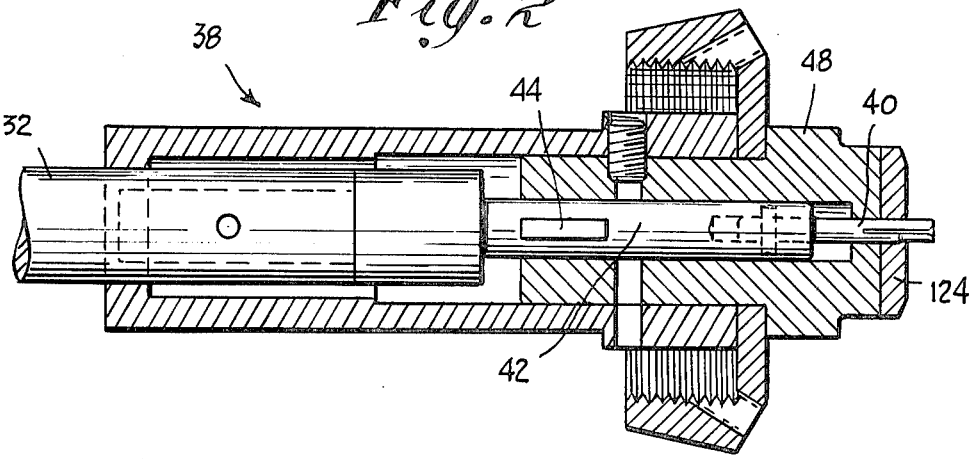
FIG. 2 is an axial sectional view through the collet assembly of the apparatus.
Figure 4:
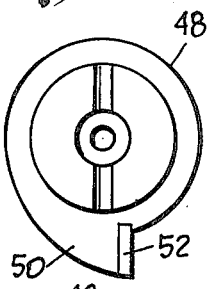
FIG. 4 is a left-end elevational view of the collet of FIG. 3.
Figure 3:
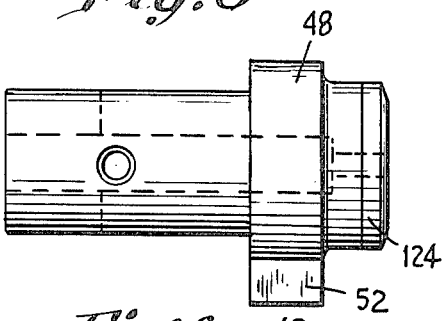
FIG. 3 is a side elevational view of the collet per se, of the assembly of FIG. 2.
Figure 5:
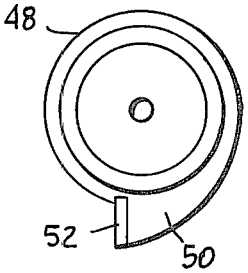
FIG. 5 is a right-end elevational view of the collet.
Figure 9:
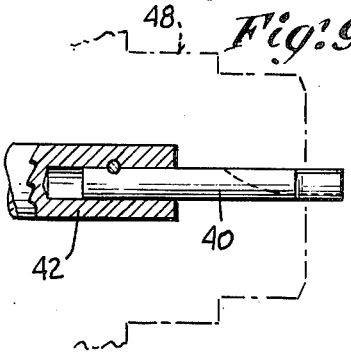
FIG. 9 is a fragmentary sectional view on an enlarged scale, of the holder device, showing an arbor, in side elevation, carried thereby.
Figure 6:
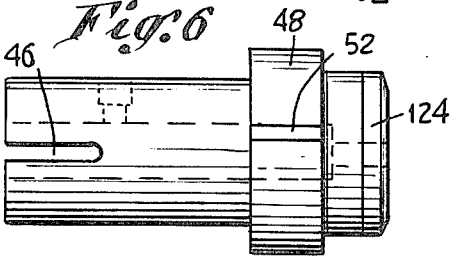
FIG. 6 is a top plan view of the collet.
Figure 7:
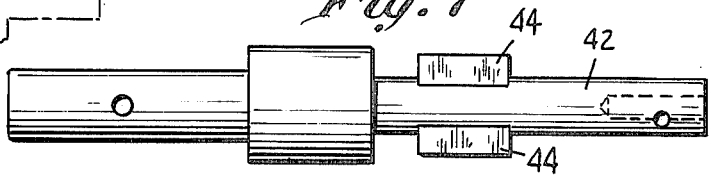
FIG. 7 is a top plan view of an arbor holder device which is received in the collet of FIGS. 2–6.
Figure 8:
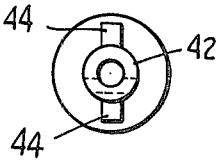
FIG. 8 is a right end elevational view of the holder device of FIG. 7.
Figure 11:
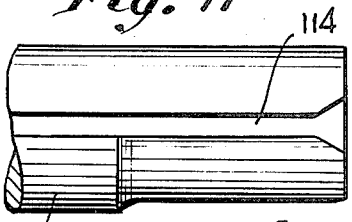
FIG. 11 is a still further enlarged fragmentary top plan view of the slotted end portion of the arbor of FIGS. 9 and 10.
Figure 12:
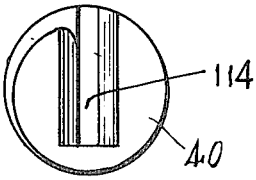
FIG. 12 is a left end elevation of the arbor of FIG. 11, shown rotated 90°.
Figure 10:
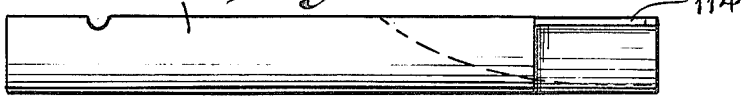
FIG. 10 is an enlarged side elevational view of the arbor, per se.
Figure 19:
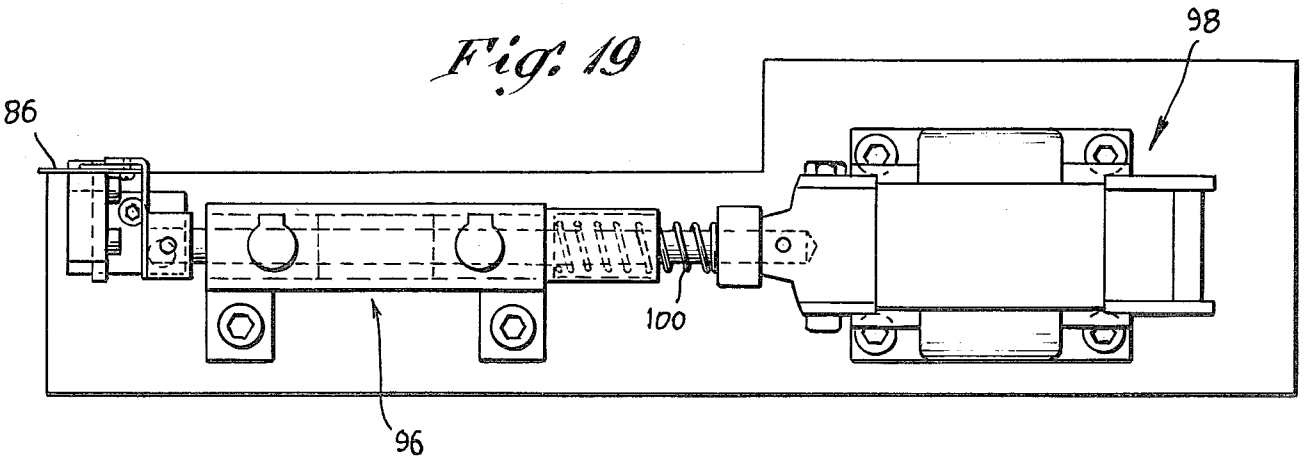
FIG. 19 is a top plan view of the solenoid-operated ribbon stop of the apparatus.
Figure 20:
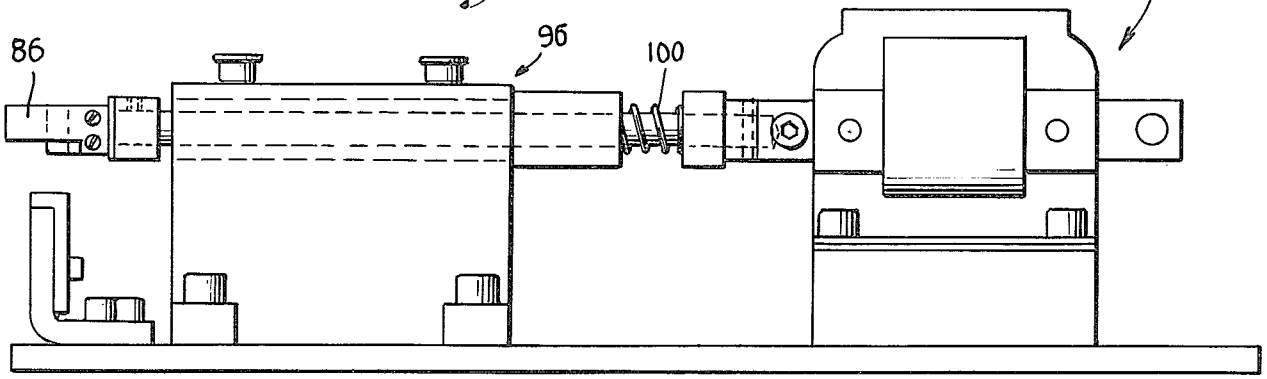
FIG. 20 is a front elevational view of the ribbon stop mechanism.

Referring to FIGS. 1 and 2, the arbor 40 is shown in an extended or advanced position shifted to the right as viewed in these figures; it can be withdrawn or retracted from right to left by similar movement of the shaft 32 as effected by the conventional feed tube mechanism of the machine. The purpose of halting of the arbor and retracting it will be explained below.

The turret assembly 14 has a rotary stop shoulder or abutment 60, FIGS. 1 and 13, which can be advanced by the turret 18 against the end of the arbor 40 or else retracted therefrom, this being accomplished by the usual advance or retraction of the turret assemblage 14 to the left and right as viewed in FIG. 1.

The front slide 20 of the machine is provided with a holder device 62, FIGS. 1, 14 and 15, which has means adapted to receive for insertion therein, and to frictionally seize, an end portion 64 of a ribbon of resistance wire stock, such portion being shown in broken outline in FIG. 14. The holder 62 comprises a base 66 secured to the front slide 20, and comprises side guides 68, 70 and a top pressure member 72 which latter is biased downwardly by springs 74.

The strip of resistance wire ribbon 64 is inserted by the operator between the relieved mouth portions 76, 78 of the guides 68, 70 and into a cavity 80 between said guides and below the pressure member 72. The ribbon is inserted fully, so as to extend between upper and lower friction pads 82, 84 of the holder device and into engagement with a stop 86 which is illustrated in broken outline in FIGS. 14 and 15. The friction pad 82 is part of a lower center piece 88 of the holder 62, as will be understood.

Also, the holder parts 72, 88 and 68, 70 can swivel upward as a unit against the action of the two springs 74 and also an additional spring 90 which is carried by a pivot 92 and bears against a pin 94 that is secured in the side guides 68, 70. The pivot 92 is threaded into the base 66 of the holder, as seen in FIG. 15. The purpose of enabling the members 72, 78 and 68, 70 to swivel upward against spring action will be explained below. However, at this point it will be understood that an operator can insert strips of resistance ribbon 64 one after another in the holder 62 to engage the stop 86. After each insertion of a strip of ribbon it is coiled about the arbor 40 in a manner to be explained shortly, this occuring prior to the insertion of a succeeding strip of ribbon.

The ribbon stop 86 is carried by a horizontal slide device 96 which is actuated from left to right and vice-versa by a solenoid 98 acting against a compression coil spring 100. The relative movements of the front slide 20 and solenoid actuator 98 are shortly to be explained as the sequence of operations involved with the machine is described; and the relation of the movements of the back slide 22 to the movements of the spindle and arbor assemblages will likewise be correlated.

Figure 21:
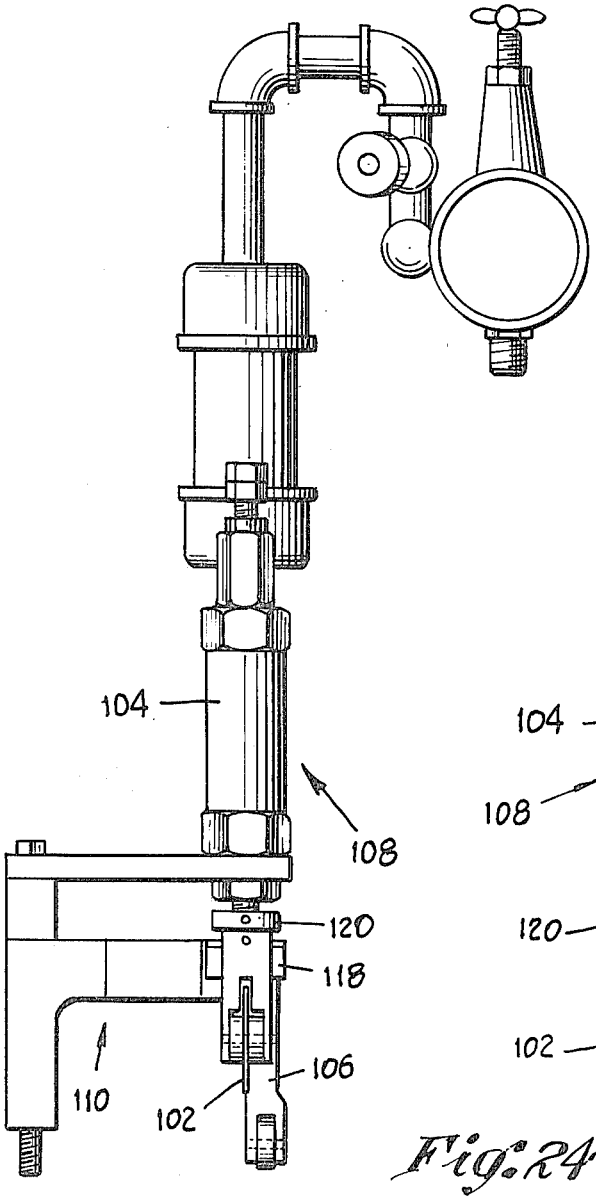
FIG. 21 is a front elevational view of the ribbon restrainer device of the apparatus.
Figure 22:
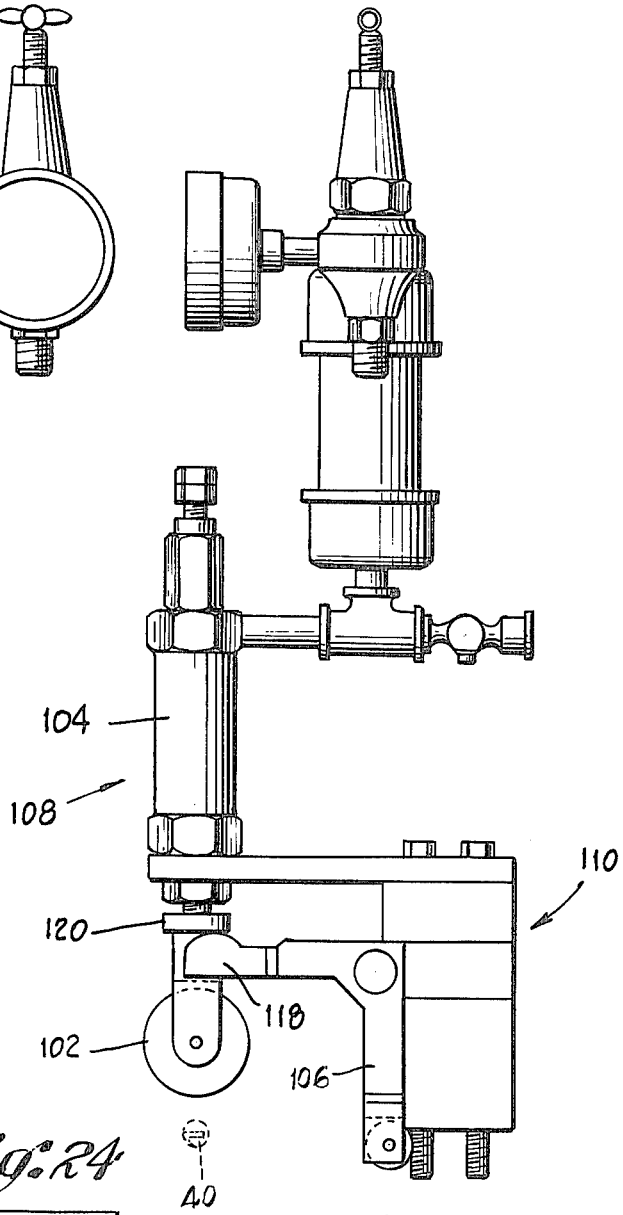
FIG. 22 is a right side elevational view of the ribbon restrainer device.

In connection with the movement of the back slide 22 there is provided a vertically shiftable pressure roll 102, FIGS. 21 and 22, that is yieldably powered by a hydraulic cylinder 104 as to its downward bias, and retracted upward by a bell crank 106 under a positive action.

The pressure roll assemblage, designated generally by the number 108, includes a bracket 110 which is secured by means of suitable cap screws to a portion 112 of the machine base 10 at the place indicated in FIG. 1. The pressure roll 102 is positioned vertically above the arbor 40, and is adapted to apply a restraining force to strips of resistance ribbon which are coiled one at a time about the arbor as the latter is put through its cycle, including a working phase wherein it is rotated at high speed.

All the related operations or movements of the front and back slides 20, 22, the turret assembly 14, the retractable stop device 96, the pressure roll device 108 and the spindle mechanism 12 involving the collet assembly 38, arbor 40, clutch 54 and drive pulleys 24, 26 will now be explained in detail, it being understood that the means by which the relative movements are effected will involve generally the cams, levers, and other actuators which are associated with the Brown & Sharpe #00 Screw Machine. Therefore, these devices are not illustrated and described herein and instead the known construction of the identified Brown & Sharp Screw Machine is hereby made a part of the disclosure of this application.

The general procedure by which the short strips of heating coil ribbon are wound into spirals will first be briefly summarized, as follows: The machine operator inserts a strip of ribbon stock into the holder 62 to a given depth, after which the machine operates to place the foremost end of the ribbon in a slot 114 of the arbor; the arbor turns and pulls the ribbon into a spiral while it is confined at both side edges and at its periphery. When the coiling of the ribbon is completed, the confining means are withdrawn, after which the arbor is withdrawn so that the coiled ribbon is completely free to fall into a container (not shown) below it. This cycle is then repeated, with the operator each time supplying a new length or strip of ribbon. The ribbon can be either perfectly flat when fed to the holder 62, or else it can be ribbed or have any other transverse configuratio, the ribbing being explained in the disclosure of my copending application above identified. The operation is very quickly and precisely accomplished by the machine, so that a high rate of superior-quality production is had.

The method of the invention involves further the particular sequences of movements, of the various slides and other cooperable components of the machine, as will now be particularly set forth herein in detail.

At the commencement of the first cycle, the operator places the machine in operation by pressing a switch (not shown) which energizes the solenoid 58 to actuate the usual starting lever (not shown) of the machine. Power is supplied to the belts 28 and 30, and the clutch 54 is in its low-speed setting. The flat, high-speed belt 30 is driving the pulley 26 but power is not transmitted to the spindle 32 or collet assembly 38 because the clutch is disengaged. The low-speed belt 28, which is involved in the effecting of the collet orientation of the slot 114 in the arbor 40, applies a yielding driving force to the pulley 24 and turns the spindle mechanism to the point where the collet assemblage 38 is halted by engagement of its shoulder 52 with the stop shoulder 56 of the back slide 22 (which latter is in its advanced or forward position). The stop shoulders 52 and 56, when engaged, align the arbor slot 114 ith the holder device 62 to correctly receive a strip of wire ribbon therefrom. Since the collet assembly 38 and spindle 32 are halted, the low speed belt 28 continually slips on the pulley 24. In its advanced position, the back slide 22 by means of a camming piece 116 thereon, raises the pressure roll 102 through actuation of a bell crank 106 which has a fork 118 engaged with a shoulder 120 carried by the mounting fitting for the pressure roll 102. The arbor 40 is in an advanced position shifted to the right, as seen in FIG. 2, wherein its protruding end is located generally in line with the friction pieces 72, 88 of the holder device 62.

The turret assemblage 14 is in a position advanced to the left from that shown in FIG. 1, wherein the rotary stop or abutment 60 thereof is essentially engaged with the protruding end of the arbor 40, and the stop member 86 is also in its advanced position, shifted to the left from the position shown in FIG. 1, so as to occupy the position illustrated in FIG. 15 wherein it projects in front of the friction pieces 72, 88. The machine is now in readiness for receiving a strip of ribbon stock from the operator. The operator inserts such stock, end first, between the mouth portions 76 and 78 of the holder device 62 and pushes the stock deeply into said device so as to spread the friction pads 82, 84 and engage it with the stop 86. The stock is thus frictionally seized by the holder. The machine now retracts the stop 86 by effecting energization of the solenoid 98 through a suitable cam and switch arrangement, the switch being designated 122 in FIG. 1 and the cam not being shown. After retraction of the stop 86, the machine advances the front slide 20 rearwardly so as to insert the protruding end of the ribbon stock into the slit 114 of the arbor. Upon this occuring, the back slide 22 withdraws (to the rear). This lowers the pressure roll 102 to the arbor and also frees the collet assembly 38 for rotation. At the same time, the clutch 54 becomes engaged, and the high-speed, flat belt 30 driving the pulley 26 now powers the spindle 32, causing the arbor 40 to rotate at a high speed. The ribbon stock is thus coiled into a spiral, and the pressure roll 102 follows the coiling, retracting as required against the action of the air pressure in the cylinder 104. Both sides of the coiled ribbon are confined, one by a facing 124 on the collet 48 and the other by the rotary abutment 60 on the turret assembly 14.

Upon completion of the coiling, the pressure roll 106 is lifted upward, the clutch 54 is disengaged and the collet assembly 58 is halted, all by a forward movement of the back slide 22. With the coiling complete, the turret assembly 14 is also withdrawn to the right, to the position shown in FIG. 1, and the arbor 40 is withdrawn to the left by the feed tube mechanism of the machine. This frees the coiled ribbon, which then can drop into a container below. The cycle thus being completed, the machine is restored to its starting position as explained above, in readiness for insertion of another strip of resistance wire in the holder 62.

Figure 24:
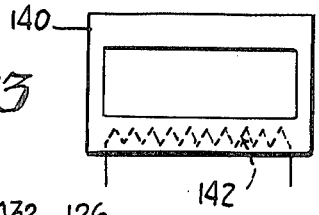
FIG. 24 is a diagrammatic showing, greatly reduced, of an annealing furnace, for annealing the formed and cut lengths of ribbon stock as produced by the apparatus of FIG. 23.
Figure 23:
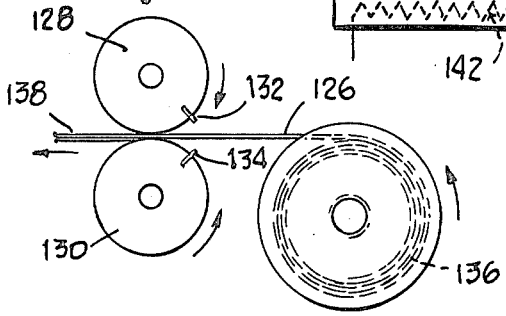
FIG. 23 is a diagrammatic showing on a reduced scale, of a pair of cooperable forming and cutting rolls between which a continuous supply of flat ribbon stock is fed for the purpose of ribbing the same and cutting the stock into predetermined lengths.

FIGS. 23 and 24 depict an apparatus and method for ribbing flat, resistance-wire stock 126, and cutting the same into predetermined lengths. Forming rolls 128, 130 have cutters 132, 134 respectively, and receive between them the ribbon stock 126 from a supply roll 136. The grooved ribbon 138 which emerges from the rollers 128, 130 is formed transversely, and in the same operation cut into predetermined lengths. Such lengths of ribbon are then annealed in a furnace 140 heated by electric coils 142 as shown in FIG. 24. The forming rolls 128, 130 illustrated in FIG. 23 and the method represented thereby are the subject of my copending patent application above identified; the disclosure thereof, in conjunction with the furnace 140, is made a part of the disclosure of the present application. After annealing of the cut lengths of ribbon, they are ready for insertion one at a time in the holding device 62 of the apparatus illustrated therein, for the purpose of effecting spiral coiling to form coils such as that shown in FIG. 25, labelled **64*a***.

Figure 26:
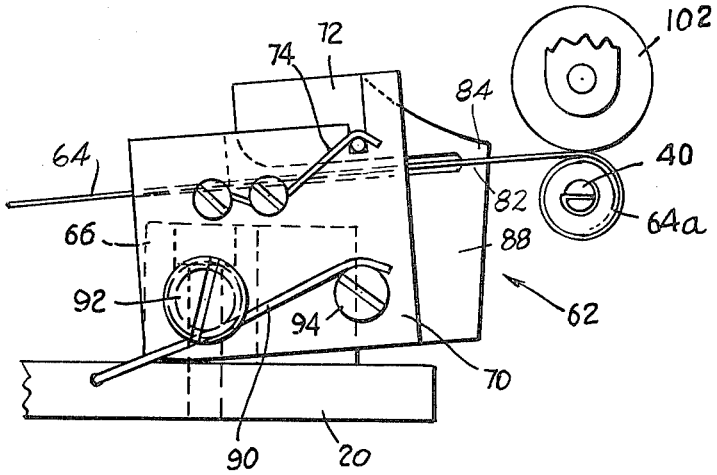
FIG. 26 is a right side elevational view of the holding device of FIG. 15, abnormally raised or pivoted upward which can be due to a jamming (not shown) of a strip of resistance wire ribbon in the process of its feeding onto the arbor of the apparatus. The ribbon restrainer device is shown in operative position.
Figure 28:
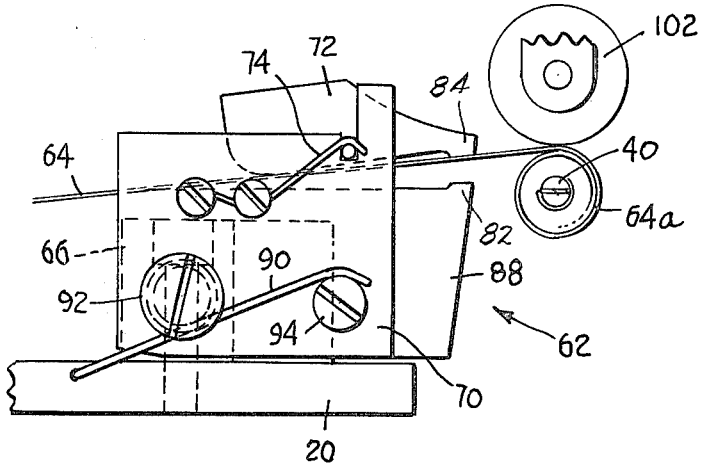
FIG. 28 is a view similar to that of FIG. 26, but showing the normal feeding of the ribbon, without jamming, in the holding device of the apparatus.

As mentioned previously, the holder device 62 has a pivot pin 92 which allows the assemblage of the friction members 72, 88 and guide members 68, 70 to swivel upward an extent, as shown in FIG. 26, if the ribbon should jam (not shown herein) on the holder during its coiling. During the normal coiling of the ribbon however, as seen in FIG. 28, when the peripheral size of the spiral increases or builds up, the upper friction member 72 will follow the build-up under force exerted by the remaining portions of the ribbon as they feed onto the arbor 40. This prevents any tendency for binding of the strip of ribbon, and provides for a smoother coiling operation. Such normal swiveling is illustrated in side elevation in FIG. 28, wherein there is shown a partially wound spiral heating coil **64*a* engaged with the pressure roll restrainer device 102 as the spiral is building up, with the ribbon feeding through the holder 62**.

Figure 25:
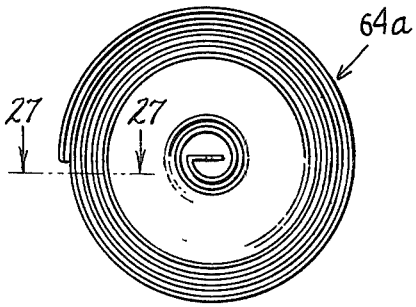
FIG. 25 is a face view, enlarged, of a spiral heating coil as produced by the invention.
Figure 27:
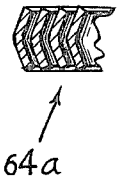
FIG. 27 is a fragmentary sectional view, enlarged, through the heating coil of FIG. 25 and illustrating the nesting of the convolutions. The section is on line 27—27 of FIG. 25.

The apparatus of the invention functions effectively to produce spiral heating coils as illustrated in FIG. 25, irrespective of the cross-sectional configuration of the ribbon. That is, the ribbon can be perfectly flat, or else it can have a V-section configuration as shown in FIG. 27, or other configurations such as a flattened Z (not shown) etc. In each instance, the method and procedure of the invention are carried out essentially in the manner explained above in detail.

It will now be understood from the foregoing that I have provided a novel and improved apparatus and method by which either flat or formed resistance wire ribbon stock is shaped into spiral coils at a high rate of production. The resultant product has the precision of machine fabrication, and exhibits a high degree of uniformity, as between consecutive wound coils.

The device is thus seen to represent a distinct advance and improvement in the technology of coil winding equipment.

Each and every one of the appended claims defines a distinct aspect of the invention separate from the others, and each claim is accordingly to be treated in this manner when the prior art devices are examined in any determination of novelty or validity.

Variations and modifications are possible without departing from the spirit of the invention.

I claim:

1. A high-production apparatus for making a spiral heating coil, comprising in combination:

(a) a machine frame, (b) an arbor having a slit, rotatably mounted on the machine frame, (c) a holder slidably mounted on the machine frame and movable between an advanced position toward the arbor and a retracted position away from the arbor, (d) said holder having means providing an opening with relieved mouth portions adapted to receive for insertion therein an end portion of a ribbon of resistance wire stock, (e) means on said holder for frictionally seizing the inserted ribbon in a position on the holder wherein an end of the ribbon is directed at the arbor slit for insertion therein as the holder is advanced toward the arbor, (f) means carried by said machine frame, providing a stop for engagement with said end of the ribbon when the latter is inserted fully in the holder, (g) means mounting said stop on the machine frame for movement between an advanced position for engagement with the ribbon end and a retracted position where it is withdrawn from the ribbon end, (h) means operative to shift the stop to the retracted position with a fast snap movement prior to advancing movement of the holder, (i) means for rotatably driving the arbor, to effect a spiral coiling of the ribbon after said end has been inserted in the slit of the arbor, and (j) means on the machine frame, for applying a yielding restraint to the ribbon as it is being coiled on the arbor.

2. An apparatus as claimed in claim 1, and further including:

(a) means on the machine frame, for confining opposite edges of the ribbon as it is being formed into the coil about said arbor.

3. An apparatus as claimed in claim 2, and further including:

(a) mechanism carried by the machine frame, for mounting one of said confining means for movement between an advanced position wherein it is engageable with a ribbon edge, and a retracted position wherein it is disengaged from the ribbon edge.

4. An apparatus as claimed in claim 3, wherein:

(a) the means for applying the yielding restraint to the ribbon comprises a pressure roll, means on the machine frame, for mounting said pressure roll for movement between an advanced position wherein it is engageable with the ribbon and a retracted position wherein it disengages the ribbon, (c) said pressure roll being withdrawn and disengaging the ribbon prior to said confining means being withdrawn.

5. An apparatus as claimed in claim 3, wherein:

(a) said confining means is withdrawn after completion of the winding of the ribbon into a coil about the arbor and withdrawal of the yielding restraint on the ribbon by said pressure roll.

6. An apparatus as claimed in claim 3, and further including:

(a) means mounting the arbor on the machine frame for axial movement between an advanced position wherein the slit thereof is aligned with the ribbon end, and a retracted position wherein the slit thereof is disposed out of alignment with the ribbon end, (b) said arbor shifting to its retracted position after said yielding restraint has been removed.

7. An apparatus as claimed in claim 1, wherein:

(a) the means for frictionally seizing the ribbon becomes operative prior to retraction of said stop.

8. An apparatus as claimed in claim 1, wherein:

(a) said means for applying a yielding restraint to the ribbon comprises a pressure roll, and (b) means mounting said pressure roll on the machine frame for movement between an advanced position toward the arbor and a retracted position away from the arbor.

9. An apparatus as claimed in claim 1, and further including:

(a) means mounting said arbor for axial movement on the machine frame between an advanced position wherein the slit thereof is aligned with the ribbon end, and a retracted position wherein the slit is disposed out of alignment with the ribbon end.

10. An apparatus as claimed in claim 1, and further including:

(a) cooperable abutment means on the arbor and machine frame, adapted to halt the arbor in a given predetermined rotative position wherein the slit is oriented with respect to the ribbon end, and (b) means for applying a yielding turning force to the arbor to bring said cooperable means into operable relationship.

11. An apparatus as claimed in claim 10, wherein:

(a) the means for rotatably driving the arbor is adapted to turn the latter at a higher speed than said yieldable turning force.

12. An apparatus as claimed in claim 10, wherein:

(a) said abutment means is operable to halt the arbor prior to the advancing movement of the holder.

13. An apparatus as claimed in claim 10, wherein:

(a) said abutment means is rendered inoperative after completion of the advancing movement of the holder, (b) said means for rotatably driving the arbor becoming effective upon completion of the advancing movement of the holder.

14. An apparatus as claimed in claim 10, and further including:

(a) means mounting the arbor on the machine frame for axial movement between an advanced position wherein the slit thereof is aligned with the ribbon end, and a retracted position wherein the slit thereof is disposed out of alignment with the ribbon end, (b) said arbor shifting to its advanced position after said abutment means becomes operative to halt turning of the arbor.

15. An apparatus as claimed in claim 1, and further including:

(a) means mounting the arbor on the machine frame for axial movement between an advanced position wherein the slit thereof is aligned with the ribbon end, and a retracted position wherein the slit thereof is disposed out of alignment with the ribbon end, (b) said arbor mounting means effecting advance of the arbor prior to the advancing of the holder and ribbon thereon.

16. An apparatus as claimed in claim 15, and further including:

(a) means for retracting the holder during the rotatable driving of the arbor.

17. A high-production method of making a spiral heating coil, which includes the steps of directing a foremost end portion of a cut length of ribbon of resistance wire stock to a location between relieved mouth portions of an opening in a holder, feeding said cut length of ribbon forwardly into said opening and into engagement with a stop, frictionally seizing the ribbon under yieldable spring action to yieldably hold the ribbon during such feeding of the same and engagement with said stop, shifting the stop out of engagement with the ribbon after such engagement has occurred, thereafter advancing the holder and ribbon toward a slitted arbor so as to insert the foremost end of the ribbon into the slit in the arbor, and then rotating the arbor while placing restraint on said ribbon, thereby to form the same into a spiral coil.

18. The method as claimed in claim 17, and including the further step of confining opposite edges of the ribbon as it is being formed into the coil about said arbor.

19. The method as claimed in claim 18, and including the further step of freeing the opposite edges of the ribbon of said confinement after the completion of the coiling of the ribbon.

20. The method as claimed in claim 19, and including the further step of removing said restraint on the ribbon prior to the freeing of said opposite ribbon edges from said confinement.

21. The method as claimed in claim 17, wherein the ribbon is frictionally seized prior to the disengagement of the stop from the ribbon.

22. The method as claimed in claim 17, wherein a rolling force is applied to the ribbon to effect the restraint thereon as the arbor coils the ribbon.

23. The method as claimed in claim 17, and including the further step of withdrawing the arbor from engagement with the inner portions of the coiled ribbon after the forming of the latter into a spiral.

24. The method as claimed in claim 23, and including the further steps of turning the arbor through a fraction of a revolution to orient the slit thereof with respect to the ribbon, and advancing the arbor axially to align the slit thereof with the ribbon prior to said endwise forward feeding of the ribbon.

25. The method as claimed in claim 24, and including the further step of retracting the holder after said axial advance of the arbor.

26. The method as claimed in claim 24, and including the steps of halting the arbor with the slit oriented as specified while simultaneously maintaining a light turning force thereon.

27. The method as claimed in claim 17, and including the further step of turning the arbor through a fraction of a revolution to orient the slit thereof with respect to the ribbon prior to said endwise forward feeding of the ribbon.

28. The method as claimed in claim 27, wherein rotating of the arbor is done at a higher speed than said turning of the arbor to orient the latter.

29. A high-production method of making a spiral heating coil of the type having nested convolutions, which includes the steps of passing a narrow, flat ribbon of resistance wire stock between a pair of counter-rotating, cooperable male and female rolls so as to impart a predetermined transverse configuration to the ribbon, directing a foremost end portion of a cut length of said ribbon to a location between relieved mouth portions of an opening in a holder, feeding said cut length of ribbon forwardly into said opening and into engagement with a stop, frictionally seizing the ribbon under yieldable spring action to yieldably hold the ribbon during such feeding of the same and engagement with said stop, shifting the stop out of engagement with the ribbon after such engagement has occurred, thereafter advancing the holder and ribbon toward a slitted arbor so as to insert the foremost end of the ribbon into the slit in the arbor, and then rotating the arbor while placing restraint on said ribbon, thereby to form the same into a spiral coil.

30. The method as claimed in claim 29, and including the additional step of cutting the ribbon into predetermined lengths as it passes between said rolls, the feeding of said ribbon comprising successively placing at spaced intervals the cut lengths of the ribbon one after another into the opening in the holder, each such fed, cut length of ribbon being frictionally seized prior to advancing the holder and ribbon toward the slitted arbor.

31. The method as claimed in claim 30, wherein the predetermined lengths of ribbon are annealed prior to feeding the same into the opening of the holder.

32. The method as claimed in claim 29, and including the further step of annealing the ribbon prior to feeding the same into the opening of the holder.

* * * * *